United States Patent [19]

de Vries

[11] 4,354,095

[45] Oct. 12, 1982

[54] INFRARED HEATING APPARATUS FOR HEATING WEB-LIKE MATERIAL

[76] Inventor: Jacob de Vries, Insulindeweg 10, 1462 MJ Middenbeemster, Netherlands

[21] Appl. No.: 210,382

[22] Filed: Nov. 26, 1980

[30] Foreign Application Priority Data

Apr. 2, 1980 [NL] Netherlands ..... 8001944

[51] Int. Cl.[3] ..... H05B 1/02

[52] U.S. Cl. ..... 219/388; 219/356; 219/494; 219/358; 219/497; 432/230; 432/37

[58] Field of Search ..... 219/388, 384, 216, 379, 219/505, 497, 501, 492, 383, 494, 356, 358; 307/117; 432/37, 59, 227, 230

[56] References Cited

U.S. PATENT DOCUMENTS

| | | | |
|---|---|---|---|
| 3,558,853 | 1/1971 | Schluntz | 219/497 |
| 3,679,518 | 7/1972 | Andler et al. | 219/497 |
| 4,049,947 | 9/1977 | Bestenreiner et al. | 219/388 |
| 4,198,560 | 4/1980 | Dietrich | 219/388 |

*Primary Examiner*—B. A. Reynolds
*Assistant Examiner*—M. H. Paschall
*Attorney, Agent, or Firm*—Kane, Dalsimer, Kane, Sullivan & Kurucz

[57] ABSTRACT

An apparatus for heating a sheet- or web-like material during its passage through a processing machine. The apparatus is provided with at least one heating panel which faces the path of travel of the material and is equipped with a number of infrared-radiation producing elements energized from an ac-source. The apparatus comprises a controlling unit for determining the heat released by the heating panel as a function of a control signal generated by a control means. The infrared elements generate short- to medium-wave infrared radiation. The control signal generated by the control means may be a function of the temperature of the material being passed along the heating panel, or a function of the rate of passage of said material.

6 Claims, 11 Drawing Figures

INFRARED HEATING APPARATUS FOR HEATING WEB-LIKE MATERIAL

BACKGROUND OF THE INVENTION

The invention relates to an apparatus for heating a sheet- or web-like material during its passage through a processing machine, provided with at least one heating panel which faces the path of travel of the material and is equipped with a number of infrared-radiation producing elements that are energized from a source of alternating current.

Such apparatuses are used in various fields, such as, for instance, for sheetfed and rotary machines, so as to attain an improvement in the quality and processability of the material processed, as well as a higher processing rate. However, the prior-art systems of this kind have the disadvantage that the heating panel is equipped with infrared elements having a relatively great thermal inertia, while the operation of the heating panel is controlled merely by on-and-off switching of the infrared elements.

Accordingly, the heating panel of the prior-art apparatus must be energized some time before the processing machine is started, so that the sheet- or web-like material may at once be heated to the required degree. These prior-art systems furthermore necessitate relatively complicated mechanical constructions in order to prevent, when the material comes to a standstill, the heat produced by the heating panel, and released by it even after it has been switched off, from reaching the sheet- or web-like material, since this material could ignite under its action. The prior-art systems moreover have the disadvantage that, because of the absence of a control of the heat supplied by the panel during operation, a variation of the rate of travel of the material results in a corresponding variation in the temperature of the material, thus causing the quality of the end product to be negatively affected.

SUMMARY OF THE INVENTION

It is an object of the invention to provide an apparatus of the above-mentioned kind, by which the aforementioned disadvantages are obviated in a simple, but nevertheless effective manner.

To this end, the apparatus according to the invention is provided with a controlling unit which determines the heat released by the heating panel as a function of a control signal generated by a control means.

This enables the heat released by the heating panel to be adjusted in a simple manner to the prevailing conditions.

The infrared elements preferably generate short- to medium-wave infrared radiation (1000 to 3000 nm). The result thus achieved is that at least substantially no heat is released to the air between the heating panel and the material, while, if required, the maximum amount of heat can be released shortly (approx. 0.5 s) after the heating panel has been switched on, and, after the heating panel is switched off, heat is no longer released after about 0.2 s.

According to the invention, the control signal generated by the control means can be a function of the temperature of the material passing along the heating panel. As an alternative, the control signal generated by the control means can be a function of the rate of passage of the material. The result attained in either case is that, upon variation of the rate of passage of the material, the heat emission of the heating panel per unit surface of the passing material can be kept at least substantially constant. Accordingly, an impermissible rise in temperature of the material is prevented, especially while the material is gathering speed after the processing machine has been put into operation as well as while the material is coming to a stop.

According to a first embodiment of the invention, the control means comprises a temperature detector which is arranged near the passing material and which generates an output signal that is proportional to the temperature of the material, as well as a control circuit of which a first input receives said output signal, while an output supplies the control signal, the magnitude of which is inversely proportional to the temperature of the material.

In this case, the control circuit preferably has a second input, to which a manually operable adjusting device is connected with which the desired temperature of the material can be adjusted.

According to a second embodiment of the invention, the control means comprises a sensor, which generates a signal which corresponds to the rate of passage of the material and which is transmitted to a first input of a control circuit, an output of which delivers the control signal, in such a manner that the control signal increases proportionally to the rate of passage of the material.

BRIEF DESCRIPTION OF THE DRAWINGS

The invention will hereinafter be explained in further detail by reference to the drawings, in which some embodiments of the apparatus according to the invention are shown.

DETAILED DESCRIPTION OF THE PREFERRED EMBODIMENTS

Figure 1:
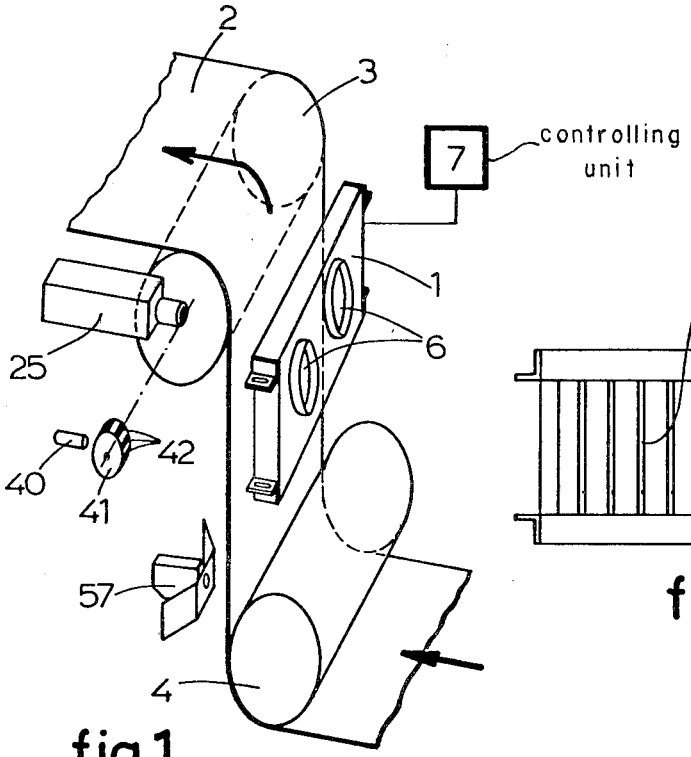
FIG. 1 diagrammatically shows the arrangement of a heating panel of the system according to the invention with respect to a web-like material.
Figure 2:
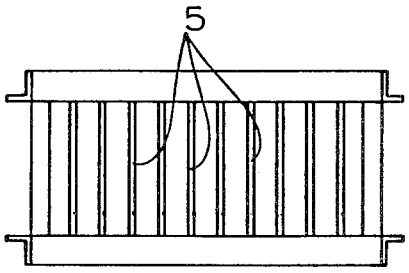
FIG. 2 is a front view of the heating panel of FIG. 1.

FIG. 1 diagrammatically shows the arrangement of a heating panel 1 of an apparatus for heating a web-like material 2 which is passed through a processing machine, such as, for instance, a printing press. Only two guide rollers 3, 4 of the processing machine are shown in FIG. 1. The heating panel 1 is equipped with a plurality of infrared elements 5 (see FIG. 2), which are provided in the form of infrared quartz tubes. Because of the elevated temperature (2100° C.) of the tungsten filament of these quartz tubes, the infrared elements 5 provide short- to medium-wave infrared radiation (1000 to 3000 nm), which offers major advantages.

First of all, the infrared elements 5 have a low thermal inertia, so that, if required, the maximum heat emission is available about 0.5 s after switching on the heating panel 1, while there is no longer any heat emission as early as about 0.2 s after switching off the heating panel 1. Further, virtually no heat is released to the layer of air between the heating panel 1 and the web 2, so that the efficiency is high. Moreover, the short-wave infrared radiation penetrates deeply into the web 2, so that there is optimum heating of the material. In the case of a rotary offset machine, wherein a suitable infrared ink is used, drying of the ink is thus introduced, causing the quality and the processability of the web 2 following the printing operation to be substantially improved.

Finally, the heating panel 1 is provided with two blowers 6 for cooling the terminal connections of the infrared elements 5.

The heat emission of the heating panel 1 is determined by a controlling unit 7 in response to a control signal provided by a control means, as will be explained hereinafter. To this end, the controlling unit 7 comprises a plurality of thyristors, which are indicated diagrammatically in FIGS. 3, 4 and 5 by a block 8 and are included in the power supply lines of the infrared elements 5. Further, the controlling unit 7 comprises a controlling circuit 9 for delivering ignition impulses to the gate electrode 10 of the thyristors 8. The time of ignition of the thyristors 8 with respect to the zero passages of the supply voltage is determined by the magnitude of the control signal.

Figure 6:
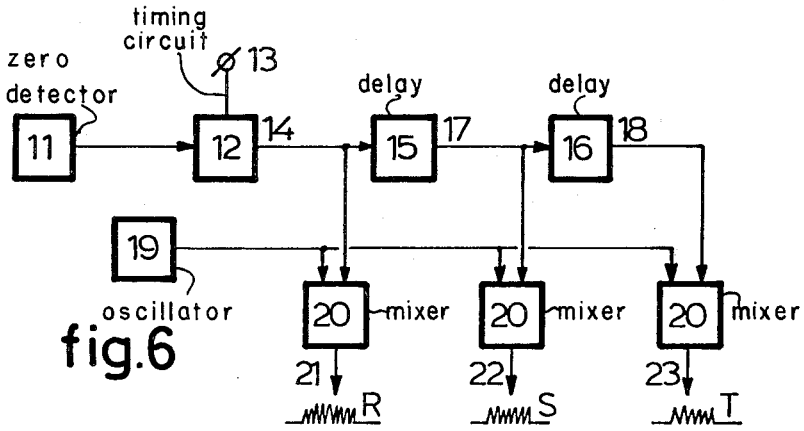
FIG. 6 is a block diagram of the controlling unit used with the apparatus of FIGS. 1 through 5.

As shown in FIG. 6, the controlling circuit 9 is provided with a detector 11, which at each zero passage delivers an impulse to a timing circuit 12, an input 13 of which receives the control signal. The control signal, the magnitude of which can vary from 0 to 5 V, determines within each half period of the supply voltage the time with respect to the zero passages at which an output impulse with a predetermined duration appears at an output 14 of the timing circuit 12. Since a varying of the heat emission of the heating panel 1 from 30 to 100 percent of the maximum heat emission is sufficient, the output 14 of the timing circuit 12 delivers, at a control signal of 0 V, an output impulse at such a time that the heating panel 1 delivers about 30 percent of the maximum heat emission.

According to the embodiment described, the infrared elements 5 are connected groupwise to a three-phase ac-source, so that three successive ignition impulses are necessary. The first ignition impulse is formed by the output impulse of the timing circuit 12. The next two ignition impulses are obtained by means of two delay means 15 and 16, which are series-connected to the output 14, and the outputs 17 and 18 of which provide the second and the third ignition impulse, respectively. In order to ensure a reliable ignition for the respective thyristors 8, the ignition impulses are each converted with the aid of an oscillator 19 and three mixing circuits 20 into a series of ignition impulses, which impulse series appear respectively at outputs 21, 22 and 23, as indicated in FIG. 6. These outputs 21–23 are coupled in a suitable manner to the gate electrodes 10 of the thyristors 8.

Figure 3:
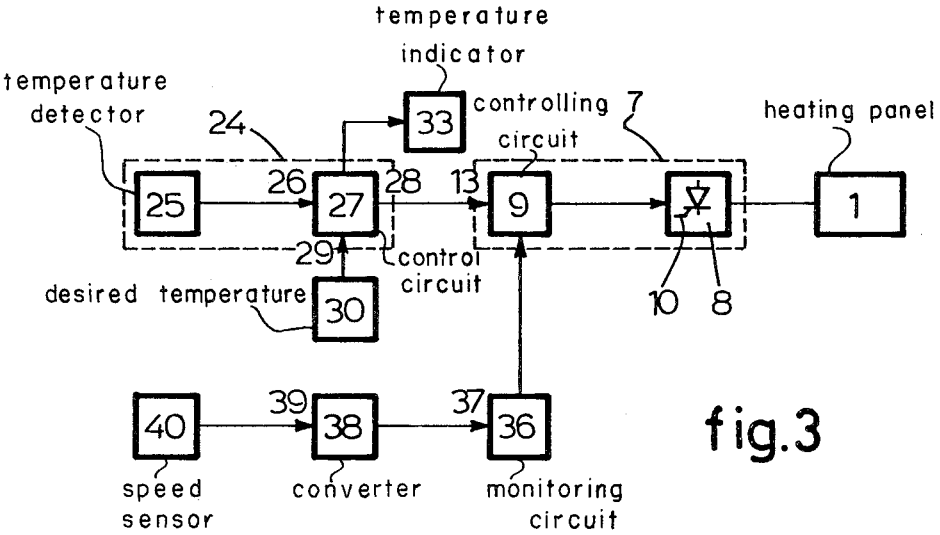
FIG. 3 is a block diagram of an embodiment of the apparatus according to the invention, wherein the release of heat is a function of the temperature of the material.

FIG. 3 indicates an embodiment of the apparatus according to the invention wherein the control signal is a function of the temperature of the web 2. In this case the control means 24, which applies the control signal to the input 13 of the controlling circuit 9, comprises a temperature detector 25 which, in the direction of passage of the web 2 is mounted beyond the heating panel 1, as shown in FIG. 1. The temperature detector 25, which may be, for example, an optical pyrometer, delivers an output signal which is proportional to the temperature of the passing web 2.

The temperature detector 25 is connected to an input of a control circuit 27, an output 28 of which delivers the control signal which is inversely proportional to the temperature of the web 2. The control circuit 27 has a second input 29, to which a manually operable adjusting device 30 is connected for adjusting the desired temperature of the web 2.

Figure 7:
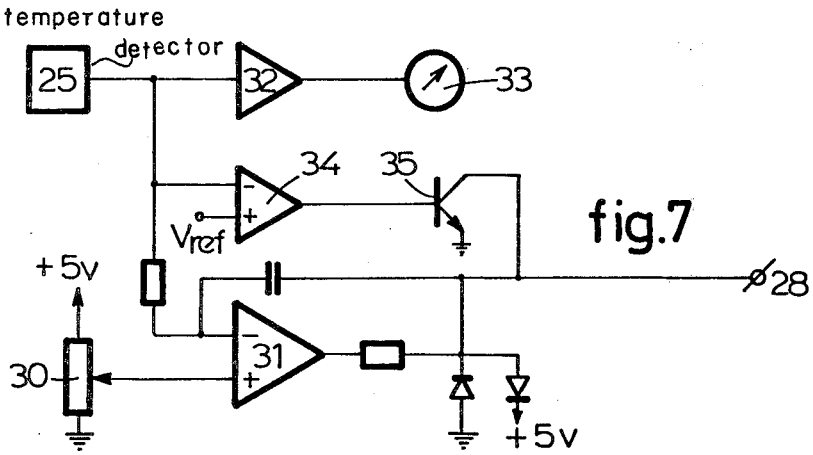
FIG. 7 is a block diagram of part of the apparatus of FIG. 3.

According to FIG. 7, which shows the control circuit 27 in more detail, the adjusting device 30, provided in the form of a potentiometer, is connected to the non-inverting input of an operational amplifier 31, which is connected as an integrator and the inverting input of which is coupled to the temperature detector 25. The output of the amplifier 31 delivers the control signal and forms the output 28 of the control circuit 27. As the output signal of the temperature detector 25 increases, i.e., at rising temperature, the magnitude of the control signal at the output 28 will decrease, and therefore the heat emission of the heating panel 1 as well, and conversely. In this manner, an equilibrium is reached at a temperature determined by the adjustment of the potentiometer 30.

Further, the output signal of the temperature detector 25 is applied to an amplifier 32, to which an indicator 33 is connected which indicates the prevailing temperature of the web 2. The control circuit 27 further comprises a comparator 34 for comparing the output signal of the temperature detector 25 with a fixed reference value, which corresponds to a given minimum temperature. When the temperature output signal drops below this reference value, the comparator 34 turns on a transistor 35 causing the output 28 to be short-circuited and the control signal to be fixed at the value zero. As a result, a failure—produced, for example, by a wire rupture or the like—does not have the effect of the heating panel 1 becoming completely energized, since there would otherwise be the possibility of fire breaking out.

In the embodiment shown in FIG. 3, a monitoring circuit 36 is provided for disconnecting the controlling circuit 9 when the rate of passage of the web 2 drops below a given value. The controlling circuit 9 then can no longer supply any ignition impulses to the thyristors 8, so that the heating panel 1 no longer emits any heat. Accordingly, energy savings can be obtained while the web 2 is being passed at a low running speed through the processing machine, and an impermissible increase in temperature of the material is prevented when the web 2 is brought to a rapid standstill.

An input 37 of the monitoring circuit 36 receives a control voltage from a converter 38, an input 39 of which is connected to a sensor 40. The sensor 40, provided in the form of an inductive transducer, co-operates with a round disc 41 which is coupled with the guide roller 3 and has a number of schematically indicated metallic projections 42 uniformly distributed on the periphery. The sensor 40 thus supplies a pulsed signal, the frequency of which corresponds to the rate of passage of the web 2. The converter 38 converts this pulsed signal into the aforementioned control voltage. The converter 38 and the monitoring circuit 36 will be further explained hereinafter.

Figure 4:
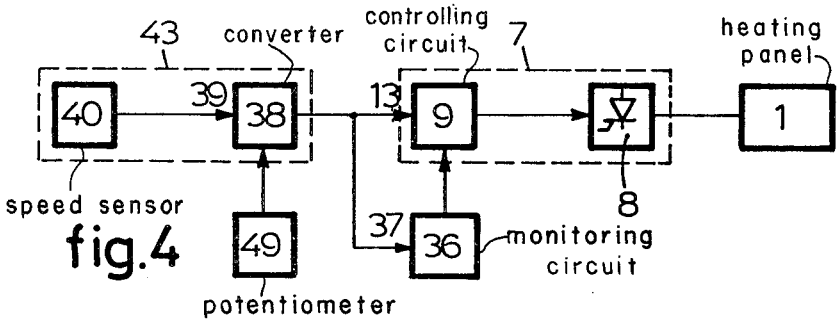
FIG. 4 is a block diagram of an embodiment of the apparatus according to the invention, wherein the heat released is a function of the rate of passage of the material.

FIG. 4 shows an embodiment of the apparatus according to the invention which is likewise equipped with the controlling unit 7, but wherein the control signal supplied at the input 13 is a function of the rate of passage of the web 2. In this case, control means 43 is constituted, for this purpose, by the sensor 40 and by the converter 38 acting as a control circuit, the output voltage delivered by the converter 38 being used as the control signal. Just as in the embodiment of FIG. 3, use is made of the monitoring circuit 36, the input 37 of which likewise receives the output voltage of the converter 38.

Figure 8:
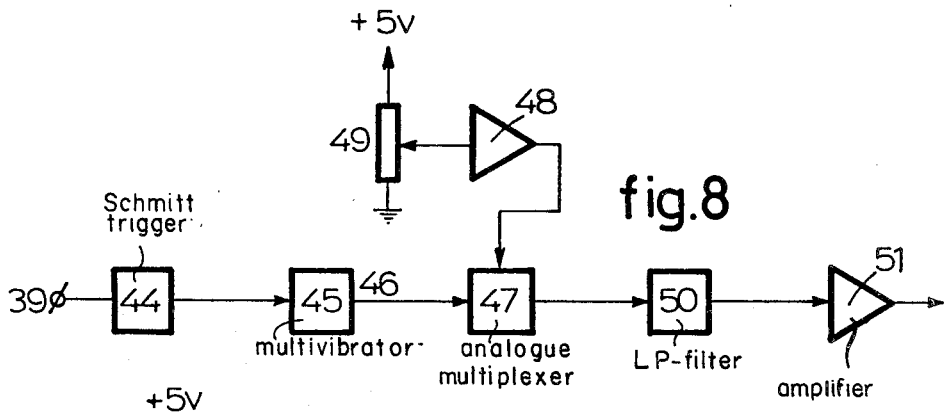
FIG. 8 is a block diagram of part of the apparatus of FIGS. 3 and 4.

The converter 38, more details of which are shown in FIG. 8, receives at the input 39 the pulsed signal of the sensor 40, which signal is converted by means of a Schmitt trigger 44 and a monostable multivibrator 45 into impulses having a predetermined duration T. These impulses appear at an output 46 of the multivibrator 45 and control an analogue multiplexer 47, the analogue input of which is connected to the output of a buffer amplifier 48. This buffer amplifier 48 delivers an output voltage which can be adjusted by means of a potentiometer 49. Impulses thus appear at the output of the multiplexer 47 which correspond in duration to the duration of the output impulses of the multivibrator 45, while the amplitude is determined by the adjustment of the potentiometer 49. The output of the multiplexer 47 is connected to a low-pass filter 50, which supplies an output dc-voltage, the magnitude of which is a function of the frequency and the amplitude of the impulses received. Finally, an amplifier 51 is provided with which the dc-voltage is brought to the desired level for the control signal.

From the above it will be understood that the convertor 38 delivers an output voltage, the magnitude of which is a function of the frequency of the pulsed signal delivered by the sensor 40, as well as of the adjustment of the potentiometer 49. The supplied output voltage which constitutes the control signal varies between 0 and 5 V. The potentiometer 49 allows adjusting the rate of passage at which the heating panel 1 emits the maximum amount of heat. If desired, the potentiometer 49 can be adjusted in such manner that, at the maximum rate of passage within the control range of the converter 38, the heat emission by the heating panel does not constitute the maximum value which can be reached.

The frequency of the pulsed signal of the sensor 40 must not exceed a predetermined value. For, no new impulse from the sensor 40 must be received within the impulse duration T of the impulses generated by the multivibrator 45. This maximum frequency determines the control range of the converter 38. The control range of the converter 38 can naturally be adapted in a simple manner to the working rate of the processing machine at which the apparatus according to the invention is used. This can be achieved, for example, by choosing a suitable number of metallic projections 42 of the disc 41.

Figure 9:
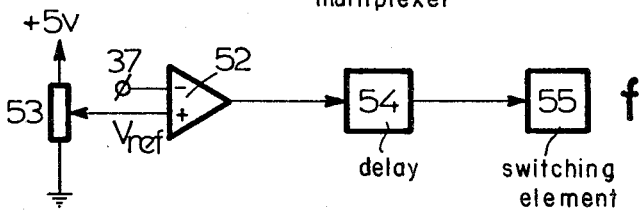
FIG. 9 is a block diagram of the monitoring circuit used with the apparatus of FIGS. 1 through 5.

As already noted, the output of the converter 38 is also connected to the input 37 of the monitoring circuit 36, which is shown in FIG. 9. The monitoring circuit 36 is provided with a comparator 52, the inverting input of which receives the output voltage of the converter 38, while a reference voltage $V_{ref}$, adjustable by means of a potentiometer 53, is connected to the non-inverting input. The comparator 52 is connected by a time-delay means 54—which is active only when the output of the comparator 52 changes from the high to the low level—to a switching element 55, with which the controlling circuit 9 can be switched on and off, for example by interrupting the supply voltage for this controlling circuit 9.

When the output voltage of the converter 38 is greater than $V_{ref}$, the output of the comparator 52 is at the low level, and the switching element 55 keeps the controlling circuit 9 energized, so that the heat emission of the heating panel 1 is controlled in the desired manner. When the rate of passage of the web 2 drops below the reference value $V_{ref}$ as adjusted with the potentiometer 53, the output of the comparator 52 changes to the high level, and the switching element 55 at once disconnects the controlling circuit 9, so that the release of heat is discontinued. As soon as the rate of passage again exceeds the adjusted reference value $V_{ref}$, the output of the comparator 52 changes from the high to the low level, which change of level is transmitted by the time-delay means 54 with some delay to the switching element 55, so that the controlling circuit 9 and therefore the heating panel 1 are energized with some delay. The time-delay element 54 prevents that the controlling circuit 9 is energized under the action of interference impulses.

Figure 5:
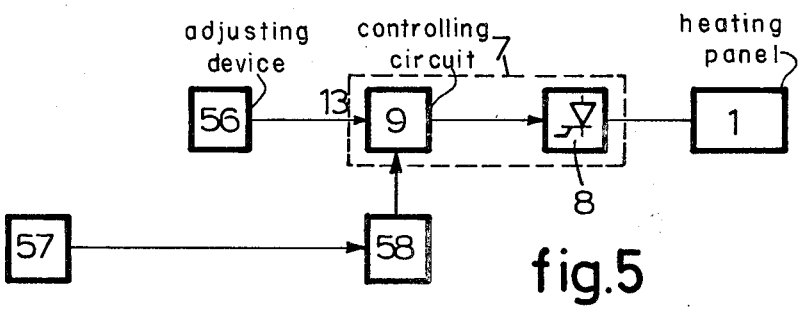
FIG. 5 is a block diagram of an embodiment of the apparatus according to the invention, wherein the release of heat is manually adjustable.

FIG. 5 illustrates a simple embodiment of the apparatus according to the invention, which is particularly suitable for use with a machine for processing materials in sheet form, such as, for example, a sheet-fed offset machine. The control signal, supplied to the input 13 of the controlling unit 7, in this case originates from a manually operable adjusting device 56, which may be constituted, for example, by a potentiometer or by a multiple-position switch.

In this embodiment, viewed in the direction of passage of the material, a detector head 57, provided just before the heating panel 1, emits a low-level signal in the presence of a sheet, and a high-level signal in the absence of a sheet. This binary signal is supplied to a processing circuit 58, which can energize and disconnect the controlling circuit 9 of the controlling unit 7.

Figure 10:
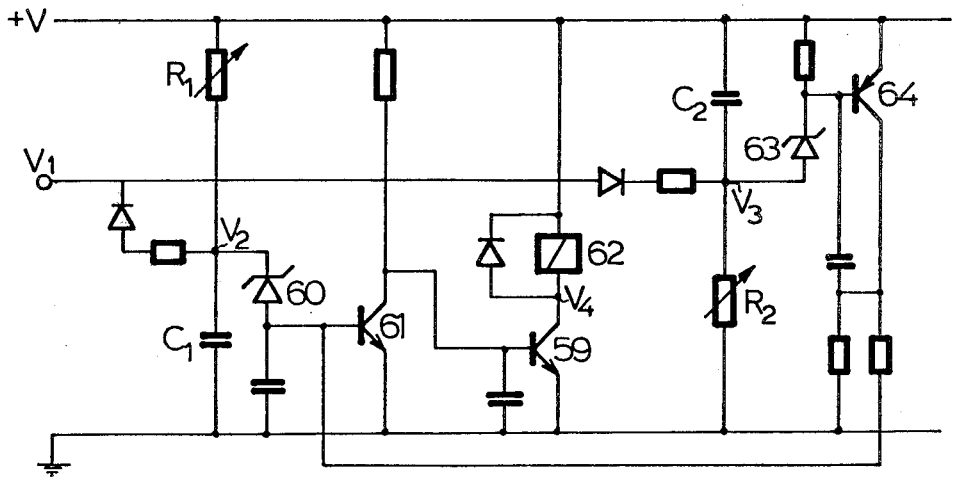
FIG. 10 is a simplified diagram of a circuit used with the apparatus of FIG. 5.

The processing circuit 58 (see FIG. 10) is provided with two RC circuits $R_1C_1$ and $R_2C_2$, by means of which it is established whether the binary signal of the detector head 57 has the low or the high level for too long a period of time. In the former case, there is a sheet in front of the detector head 57 and therefore in front of the heating panel 1 as well, while the processing machine is at a standstill or at least is passing the material at a speed which is too low. The heating panel 1 is then switched off so as to prevent the material from overheating, which could cause fire to break out. In the latter case, no successive sheet appears within the period determined by the time constant $R_1C_1$, and the heating panel 1 is switched off in order to avoid unnecessary energy consumption.

Figure 11:
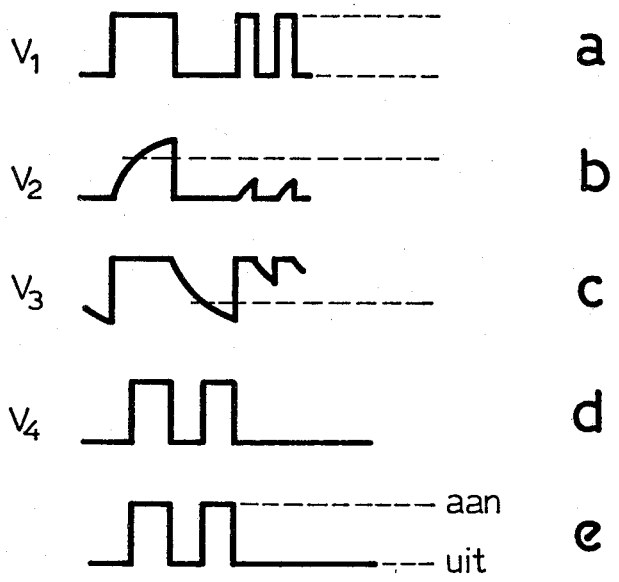
FIG. 11 shows some voltages which can occur in the circuit of FIG. 10.

Shown in FIG. 11, a–e, are the voltages $V_1$, $V_2$, $V_3$ and $V_4$ occurring in the processing circuit 58 and the switching state of the controlling circuit 9 and therefore of the heating panel 1. The voltage $V_1$ corresponds to the output signal of the detector head 57, while $V_2$ is the voltage on the capacitor $C_1$, and $V_3$, the voltage on the capacitor $C_2$. $V_4$ is the collector voltage of the transistor 59.

The resistances $R_1$ and $R_2$ are adjustable, so that the respective time constants $R_1C_1$ and $R_2C_2$ can be adapted as required.

The operation of the processing circuit is as follows:

If no sheet of material is observed for some time by a detector head 57, the voltage $V_2$ on the capacitor $C_1$ increases until a zener diode 60 turns on, which causes the transistor 61 to turn on as well. The voltage level at which this takes place is indicated with a broken line in FIG. 11*b*. This causes the transistor 59 to be switched off and a relay 62 connected in the collector line to become inoperative, so that the controlling circuit 9 is disconnected.

If a new sheet of material follows before the zener diode 60 turns on, the transistor 59 remains in the conducting state, and the controlling circuit 9 is not disconnected.

The voltage $V_1$ has a low value when the detector head 57 detects a sheet. As a result, the voltage $V_3$ can decrease, so that, upon reaching a value indicated by a broken line in FIG. 11*c*, a zener diode 63 turns on, which causes a transistor 64 to turn on. As a result, the transistor 61 becomes conductive and the transistor 59 is switched off, so that the relay 62 again becomes inoperative and the controlling circuit 9 is disconnected.

If the sheet has passed before the zener diode 63 turns on, the transistor 59 remains conductive, and the controlling circuit 9 is not disconnected.

From the above it appears that with the use of the apparatus according to FIG. 5 a favourable energy consumption can be realized in the processing of materials in sheet form, with the heating panel 1 emitting heat only when material occurs in front of the heating panel. Furthermore, overheating of the material during standstill is prevented, since the heating panel is disconnected on time.

The invention is not restricted to the examples of embodiment described hereinabove, which can be varied in a number of manners within the scope of the invention.

I claim:

1. Apparatus for use in heating a web-like material during its passage through a processing machine, said apparatus comprising at least one heating panel which faces a path of travel taken by a web-like material when passing through a processing machine, said panel is equipped with at least one short-to-medium-wave infrared-radiation producing element, a controlling circuit having means for varying the heat emission of the heating panel as a function of the magnitude of a control signal, a control means providing an output to the controlling circuit of the control signal, said control means comprising a sensor generating a signal corresponding to the rate of passage thereby of web-like material which signal is supplied to a first input of a control circuit, and a second input of the control circuit to which a manually operable adjusting device is connected for adjusting the rate of change of the control signal as a function of the signal corresponding to the rate of passage of web-like material.

2. Apparatus for use in heating a web-like material during its passage through a processing machine, said apparatus comprising at least one heating panel which faces a path of travel taken by a web-like material when passing through a processing machine, said panel is equipped with at least one short-to-medium-wave infrared-radiation producing element connected to a power supply through semiconductor switching means, a controlling circuit for delivering ignition impulses to the semiconductor switching means, wherein the ignition time within each half period of the power supply voltage is determined by a control signal in such a manner that the heat emission of the heating panel varies as a function of the magnitude of the control signal, said control signal being provided to the controlling circuit by a control means which comprises a sensor generating a signal corresponding to the rate of passage thereby of web-like material, which signal is supplied to a first input of a control circuit an output of which delivers the control signal which increases as a function of increasing rate of passage of web-like material, wherein the control circuit has a second input to which a manually operable adjusting device is connected for adjusting the rate of increase of the control signal as a function of the increasing rate of passage of web-like material.

3. Apparatus according to claims 1 or 2, wherein the sensor generates a pulsed signal, the frequency of which is proportional to the rate of passage of web-like material, the control circuit comprising a converter which is provided with an impulse generator which, in response to the pulsed signal, delivers output impulses having a predetermined impulse duration which are supplied to a switch input of an analog switching means, an analog input of which receives a dc-voltage the value of which is determined by the adjusting device, while an analog output is connected to a low-pass filter an output of which controls an amplifier which provides the control signal.

4. Apparatus according to claims 1 or 2, wherein the control signal is also supplied to a monitoring circuit which disconnects the controlling circuit when the control signal is smaller than a reference value corresponding to a given rate of passage.

5. Apparatus according to claim 4, wherein said reference value is adjustable by means of an adjusting device.

6. Apparatus according to claim 4, wherein the monitoring circuit comprises a time-delay means which energizes the controlling circuit after a predetermined period of time during which the control signal has exceeded the reference value.

* * * * *